US005676365A

United States Patent [19]

Pittelkow et al.

[11] Patent Number: 5,676,365

[45] Date of Patent: Oct. 14, 1997

[54] ADJUSTABLE SLUICE FOR SHEETS OF PAPER OF THE LIKE

[75] Inventors: Ralph Pittelkow, St. Georgen; Werner King, Lauterbach, both of Germany

[73] Assignee: Mathias Bäuerle GmbH, St. Georgen, Germany

[21] Appl. No.: 686,213

[22] Filed: Jul. 23, 1996

[30] Foreign Application Priority Data

Dec. 1, 1995 [DE] Germany ..... 295 19 061.2

[51] Int. Cl.[6] ..... B65H 3/52

[52] U.S. Cl. ..... 271/125; 271/121

[58] Field of Search ..... 271/121, 125, 271/182

[56] References Cited

U.S. PATENT DOCUMENTS

| | | | |
|---|---|---|---|
| 5,026,043 | 6/1991 | Tanjo | 271/121 |
| 5,163,669 | 11/1992 | Hurd et al. | 271/125 |
| 5,360,206 | 11/1994 | Haar | 271/125 |

FOREIGN PATENT DOCUMENTS

| | | |
|---|---|---|
| 0487326A | 5/1992 | European Pat. Off. . |
| 34 12 574 C1 | 10/1985 | Germany . |

*Primary Examiner*—H. Grant Skaggs

*Attorney, Agent, or Firm*—McGlew and Tuttle

[57] ABSTRACT

A web and sheet sluice adjustable to different material thicknesses for sheets of paper or the like, which are fed to a processing or treating unit. The sluice has a passage gap between a friction roller, which rotates continuously during the working operation, and an axially parallel braking roller, which is radially adjustable in relation to the friction roller. An electric switching element sends a control signal for an electric circuit during the adjustment of the passage gap to the thickness of a sample located in the passage gap. The braking roller is rotatably mounted on the cylindrical eccentric of an eccentric shaft, which can be driven by a first electric motor drive and can optionally be adjusted to both directions of rotation, and with the friction roller stationarily stopped, it can be driven by a second electric motor drive at a speed of rotation that is substantially higher than the velocity of adjustment of the braking roller via a driving gear which can be moved out of its normal position. When the gap width to be set has been reached, the switching element, by the switching signal of which the two electric motor drives are stopped, is actuated.

10 Claims, 4 Drawing Sheets

ADJUSTABLE SLUICE FOR SHEETS OF PAPER OF THE LIKE

FIELD OF THE INVENTION

The present invention pertains to a sluice adjustable to different material thicknesses for sheets of paper, paper webs, films or similar materials, which are fed to a processing or treating unit, wherein the sluice has a passage gap between a friction roller, which continuously rotates during the working operation, and a braking roller, which is radially adjustable in relation to the friction roller and is axially parallel to it, and wherein an electric switching element is present, which sends a control signal for an electric circuit at the time of the adjustment of the passage gap to the thickness of a sample located in the passage gap.

BACKGROUND OF THE INVENTION

A sheet feeder with a decollating device has already been known (DE-34 12 574 C1), which has a rotatingly driven friction roller and a braking roller adjustable thereto radially with a braking surface on its circumference. The braking surface forms a wedge-shaped passage gap with the jacket surface of the friction roller. To make it possible to adjust this passage gap to a certain sheet thickness, a frame is arranged on a support carrying the braking roller; this frame is radially movable in relation to the friction roller and to the braking roller and has a scanning surface that can be placed on the jacket surface of the friction roller in the area of the passage gap. In addition, the frame is provided with an electric signal switch of a signal circuit, which can be actuated by a scanning element scanning the position of the braking roller in relation to the scanning surface or the friction roller. When the correct size of the passage gap is reached, the signal circuit, controlled by the signal switch, generates an optical and/or acoustic signal. The braking roller is arranged eccentrically on an adjusting shaft, whose angular position can be fixed.

After the passage gap has been set to a width corresponding to a certain paper grade or a certain sheet or film thickness, it is necessary the bring the frame again into a starting position in which it is lifted off from the passage gap and to fix it in that position. Additional locking devices, which make the entire unit complicated and correspondingly expensive, are necessary for this. The adjustment of the passage gap to a certain sheet thickness is, on the whole, cumbersome and time-consuming with this device.

SUMMARY AND OBJECTS OF THE INVENTION

The primary object of the present invention is to provide a sluice of the above-described type and to adjust its width of opening to the thickness of a paper or other material to be processed in a very short time and with very simple manipulation with such an accuracy that guarantees the trouble-free operation of the sluice, especially for decollating sheets and for removal from a stack.

This object is accomplished according to the present invention in that the braking roller is rotatably mounted on the cylindrical eccentric of an eccentric shaft, which can be driven by a first electric motor drive and can be adjusted to either direction of rotation as needed, and with the friction roller stationarily stopped, it can be driven by a second electric motor drive at a speed of rotation that is substantially higher than the velocity of adjustment of the braking roller via a drive part, which can be moved from its normal position and actuates the switching element, whose switching signal stops the two electric motor drives, when the gap width to be set has been reached.

The special advantage of the principle of operation of this solution according to the present invention is the fact that the adjustment of the passage gap of the sluice to the thickness of a sheet of paper or the like does not have to be performed by a manual adjustment of the friction roller or of the braking roller, but only an electfie or electronic switch or a pushbutton needs to be actuated for this purpose after the sheet of paper, to the thickness of which the passage gap is to be adjusted, has been placed into the passage gap. A sufficiently high accuracy of the gap width can, in principle, also be achieved with this solution according to the present invention, so that trouble-free operation of the sluice can be guaranteed. The time required for adjusting the width of the passage gap is also reduced to a minimum, because manual manipulations are completely avoided during the adjustment.

While it is possible, in principle, and provisions are also made for this in the exemplary embodiment described below, to provide two separate electric or electronic switches for opening and closing the passage gap, the design of the invention wherein a microprocessor is provided for controlling the two motor drives and only one electric or electronic switch is associated with the microproeeesor, offers the advantage that it completely avoids operating errors of the electric control unit, because only a single switch, which is to be operated manually, is present.

The delay between the time at which the gap width corresponding to the thickness of the sheet of paper and the generation of the switching signal by the switching element, which delay is due to the principle of operation, can be very exactly compensated by the design according to the invention wherein after completion of an adjusting movement in the closing direction of the passage gap, the drive of the eccentric shaft performs a minimum opposite opening movement. However, this improvement in the accuracy of adjustment is necessary in the case of very thin papers or films only and then only if there is no sufficient transmission ratio between the velocity of pivoting of the eccentric shaft and the speed of rotation of the braking roller during the adjustment process, i.e., when the braking roller does not rotate substantially faster than the eccentric. This can be attributed to the fact that the actuation of the switching element depends on the speed of rotation or the circumferential velocity of the braking roller, at which the movable driving gear is also moved out of its normal position to actuate the signal switch.

Further features of the invention, discussed below, contribute to the simplification of the design, to an increase in the reliability of operation, and partially also to the increase in the accuracy of adjustment.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings.

One exemplary embodiment of the present invention will be explained in greater detail below on the basis of the drawings. In the drawings.

DESCRIPTION OF THE PREFERRED EMBODIMENT

Figure 1:
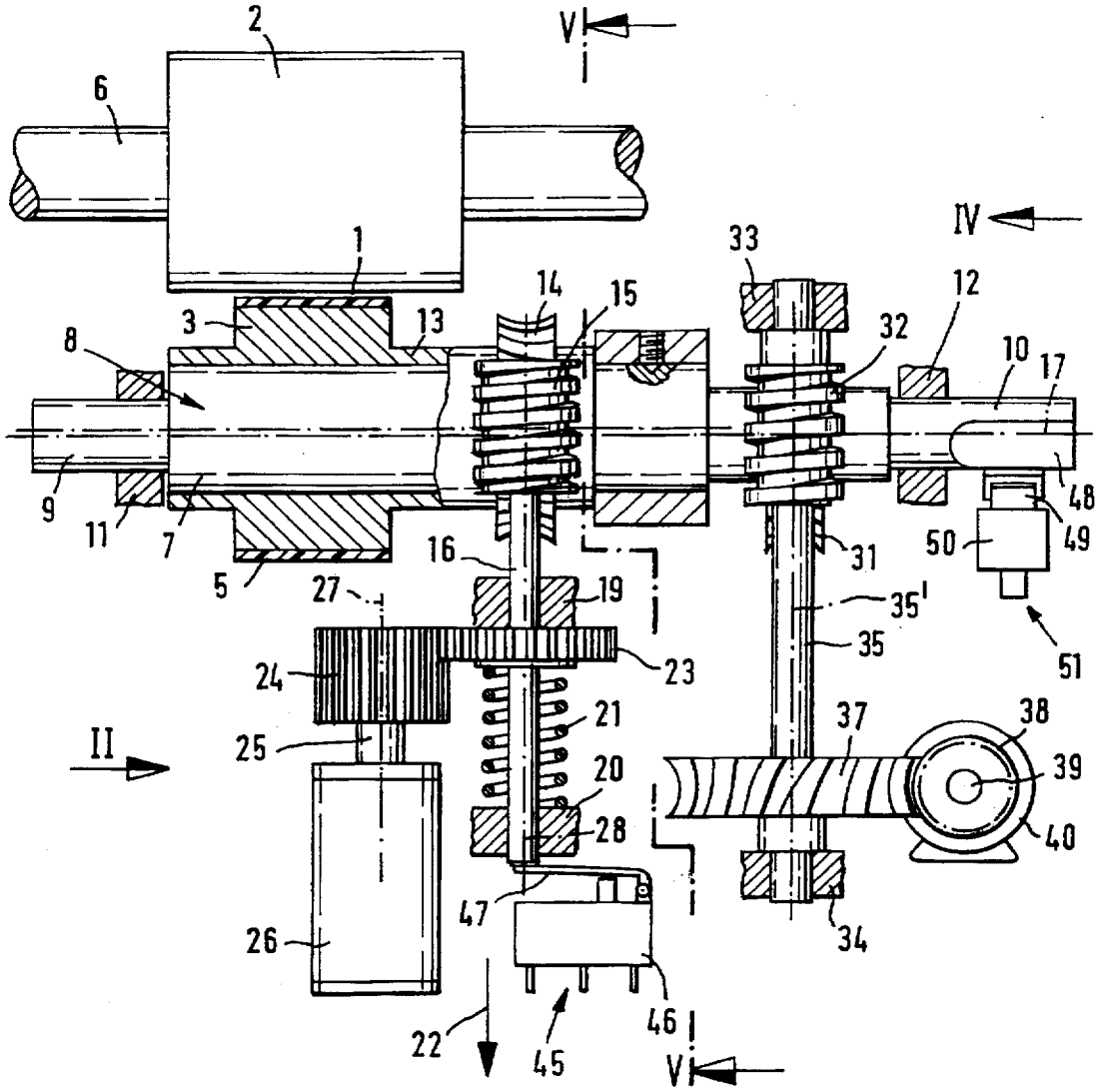
FIG. 1 is a partially cutaway side view of the general design of a device for adjusting a sluice for sheets of paper, paper webs, films or the like to the thickness of these materials.
Figure 2:
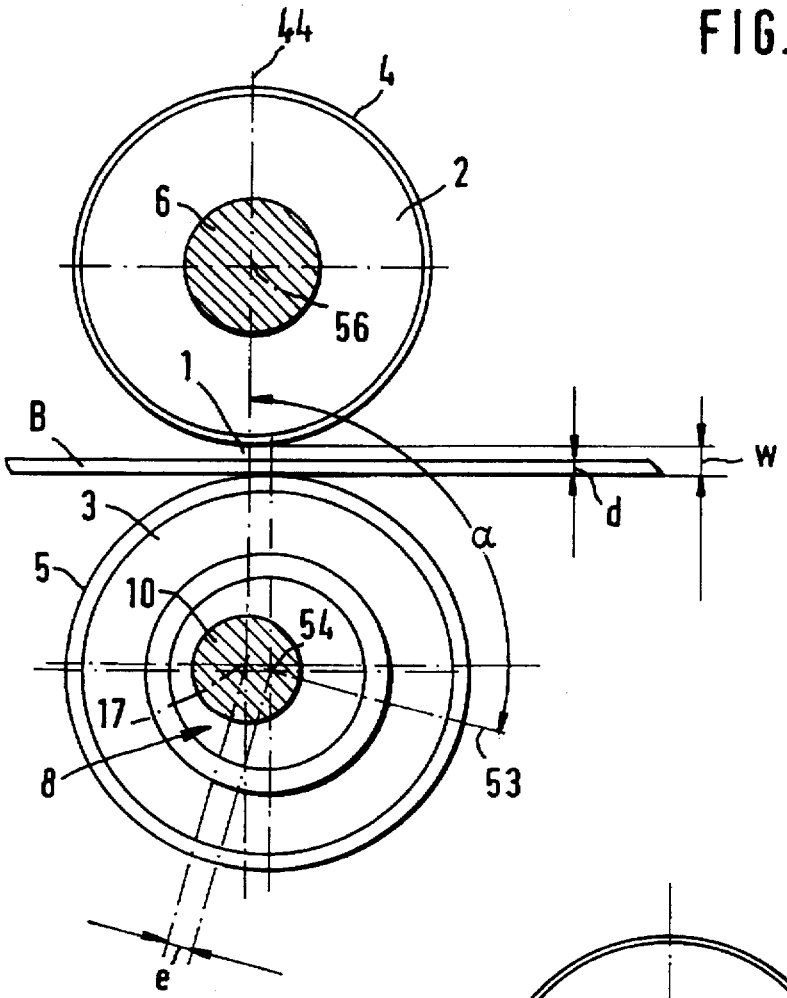
FIG. 2 is a sectional view of the opened sluice at the maximum width of the passage gap in a front view II of the friction roller and of the braking roller from FIG. 1.
Figure 3:
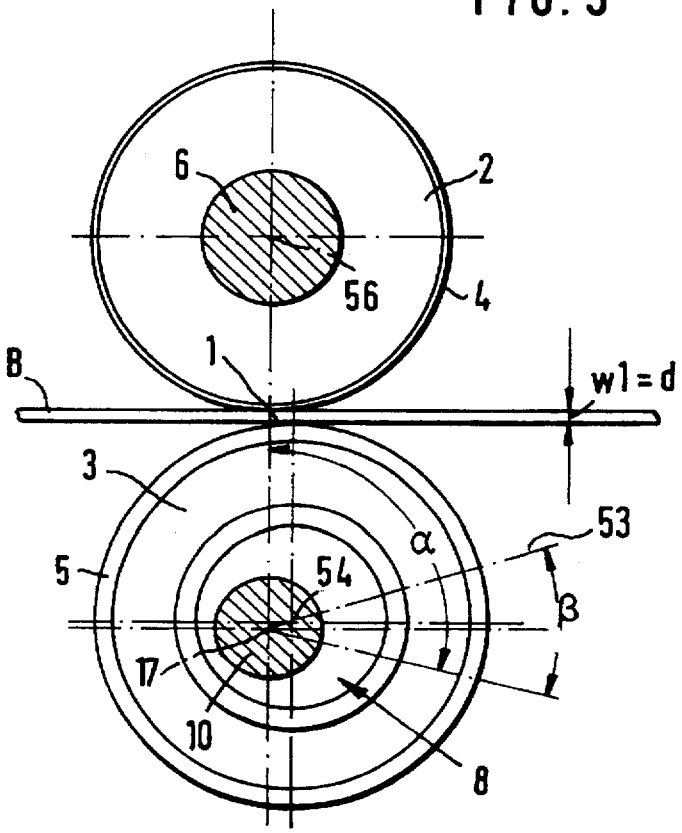
FIG. 3 is the same view as in FIG. 2 with the sluice closed.

Referring to the drawings in particular, the invention comprises a device in the form of a sluice adjustable to different material thicknesses for sheets of paper, paper webs, films or the like, which are fed one by one to a processing or treating unit by means of this device. The sluice is formed by a passage gap 1, which can be adjusted to different widths and is present between a friction roller 2 and a braking roller 3, which is radially adjustable in relation to the axis 56 of the friction roller 2 and is axially parallel thereto. The friction roller 2 is provided with a friction jacket 4, which has a substantially higher coefficient of friction, e.g., with respect to normal paper, than does the friction jacket 5 with which the braking roller 3 is provided. The friction roller 2 is mounted on a shaft 6, which is driven continuously during the normal working operation, i.e., the decollation operation, at a relatively high speed of rotation, especially at a relatively high circumferential velocity, but which is stopped when the passage gap 1 must be adjusted to a new width.

The braking roller 3 is rotatably mounted on a cylindrical eccentric 7 of an eccentric shaft 8. The eccentric shaft 8 is mounted rotatably in stationary bearings 11 and 12, respectively, by means of two coaxial bearing journals 9 and 10. During the normal working operation, when the friction roller 2 rotates at a relatively high speed, the braking roller 3 is stopped. Its task is to prevent two sheets of paper from passing simultaneously through the passage gap 1 set. The task of the rotating friction roller 2 is to transport the individual sheets of paper through the passage gap 1.

The braking roller 3 is provided with a hub 13, to which a worm gear 14 is fastened, which is engaged by a worm 15. The worm 15 is fastened to a worm shaft 16, whose axis 16' extends at right angles to the axis of rotation or bearing axis 17 of the eccentric shaft 8 and is mounted in the respective bearings 19 and 20 and also axially movably against the action of a restoring spring 21 in the direction of the arrow 22.

To prevent the engagement between the worm 15 and the worm gear 14 from changing during an adjustment of the eccentric 7, the two bearings 19 and 20 are arranged in a frame part, which is not visible in the drawing and which in turn is mounted either on the hub 13 or on the eccentric 7.

A spur gear 23 is arranged firmly seated on the worm shaft 16 between the two bearings 19 and 20, and a restoring spring 21, which concentrically surrounds the worm shaft 16 between the spur gear 23 and the lower bearing 20, is supported on the spur gear 23. The spur gear 23 engages a pinion 24, which is fastened to the motor shaft 25 of an electric motor 26. Due to the radial serrations of the spur gear 23 and of the pinion 24, the spur gear 23 can be displaced in the axial direction in relation to the pinion 24, because the axis 27 of the pinion extends in parallel to the axis 28 of the worm shaft 16.

A second worm gear 31, which is arranged concentrically with the axis of rotation or bearing axis 17 of the eccentric shaft 8, is fastened on a concentric section 8' of the eccentric shaft 8, offset in relation to the worm gear 14 in the axial direction. A worm 32, which is fastened on a worm shaft 35 mounted in two bearings 33 and 34 in an axially fixed position, engages the said worm gear 31. Another worm gear 37, which engages a worm 38 seated on the motor shaft 39 of a reversible electric motor 40, i.e., an electric motor whose direction of rotation can be reversed, is fastened on the said worm shaft 35, whose axis 35' also extends at right angles to the bearing axis 17 of the eccentric shaft 8.

Figure 4A:
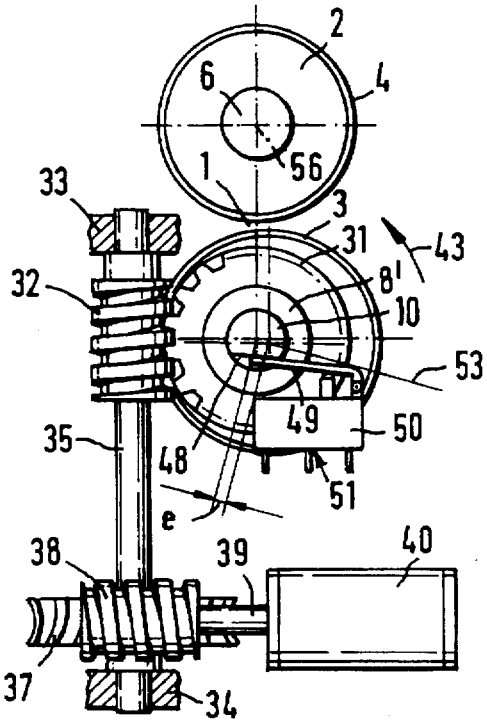
FIG. 4*a* is a view IV from FIG. 1 with the passage gap opened.
Figure 4B:
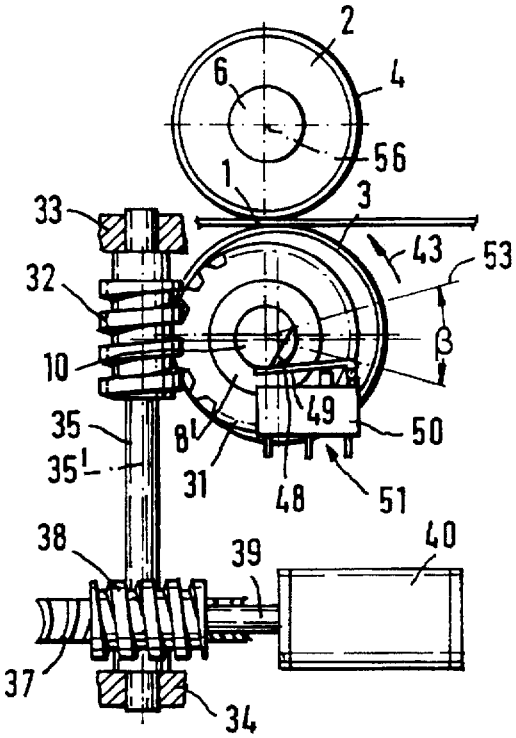
FIG. 4*b* is the same view as FIG. 4*a*, but with a different angular position of the eccentric shaft.
Figure 4C:
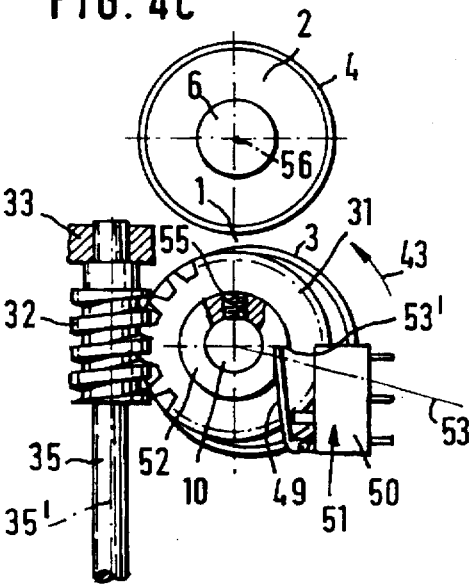
FIG. 4*c* is a partial view corresponding to FIG. 4*a* with another arrangement of the electric switch actuated by the eccentric shaft and with another actuating element for this electric switch.
Figure 5A:
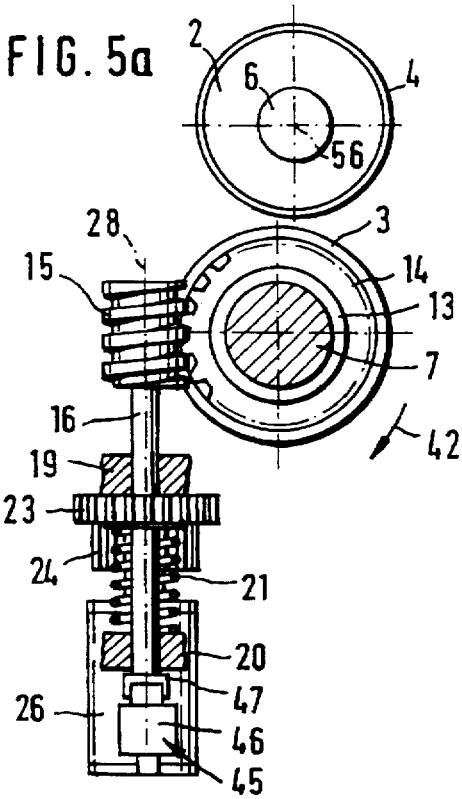
FIG. 5*a* is a section V—V from FIG. 1 during the adjustment process to a certain width of the passage gap.
Figure 5B:
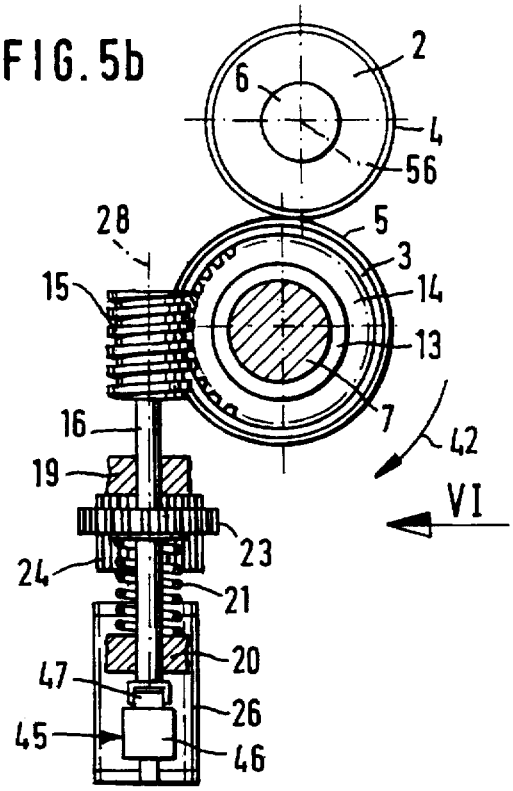
FIG. 5*b* is the same view as FIG. 5*a*, but in another operating position of the movable driving gear and of the eccentric shaft.
Figure 5C:
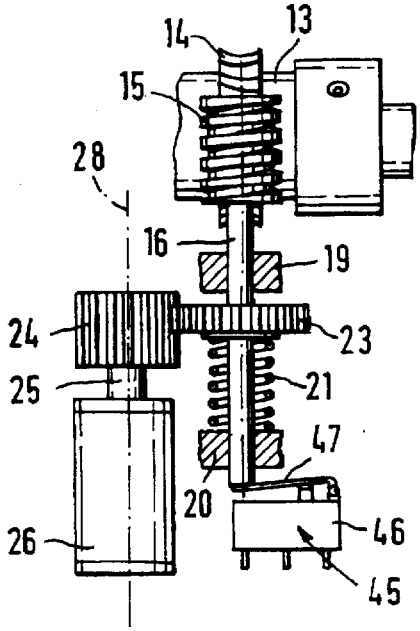
FIG. 5*c* is a partial view VI from FIG. 5*b*.

While the eccentric shaft 8 can be pivoted optionally in both directions around the axis of rotation or bearing axis 17 due to the electric motor drive associated with it in the form of the electric motor 40 in order to increase or decrease the passage gap 1, the braking roller 3 on the cylindrical eceenttic 7 is driven at a substantially higher velocity during the pivoting movement of the eccentric shaft 8, which takes place in the closing direction, in a direction of rotation that is indicated by the arrows 42 in FIGS. 5*a* and 5*b*. The opposite direction of the pivoting movement of the eccentric shaft 8 or of the eccentric 7 with the braking roller 3 rotating thereon is indicated by the arrows 43 in FIGS. 4*a* through 4*e*.

An electric switching element 45 in the form of a microswitch 46, whose switch lever 47 can be actuated by the worm shaft 16, is located in the range of axial displacement of the worm shaft 16, over which the braking roller 3 is driven at a high velocity. The switch lever 49 of a microswitch 50 is also located in the range of pivoting of a flattened part 48 of the axle journal 10 of the eccentric shaft 8; this switch lever 49 is used as an additional electric switching element 51 for setting the initial angular position of the eccentric shaft, in which the sluice, i.e., the passage gap 1, is open for loosely inserting a sheet of paper B, to the thickness d of which the passage gap 1 is to be adjusted.

In the embodiment shown in FIG. 4*c*, the axle journal 10 is not provided with a flattened part 48, but with a switching ring 52, which is attached displaceably in the circumferential direction, is fixed by means of a radial locking screw 55, and has a radial incision 53', into which the switch lever 49 of the microswitch 50 can drop when the eccentric shaft 8 assumes its initial angular position shown in FIGS. 4*c* or in FIG. 4*a*, in which the passage gap has its maximum width w, which is preferably set at about 1 mm.

The time needed to adjust the passage gap 1 to the actually desired width w, which corresponds to the thickness d of a sheet of paper or the like, depends on the initial angular position from which the eccentric shaft 8 must be pivoted in the closing position indicated by arrow 43 and on the value of the adjustment angle β now swept. Providing the switching dug 52 adjustably fastened to the axle journal 10 of the eccentric shaft 8 therefore offers the advantage that its initial angular position can also be changed by changing its angular position in relation to the plane of eccentricity 53. This also makes it possible at the same time to change the initial width of opening w of the passage gap o 1 and consequently the adjustment angle β.

The plane of eccentricity 53 is the plane in which both the axis of rotation 17 of the eccentric shaft 8 and the axis 54 of the cylindrical eccentric 7 are located.

If the initial width of opening w of the passage gap 1 is to be about 1 mm, as is intended in the exemplary embodiment, an eccentricity e of about 1 to 2 mm is preferably selected, and an initial angular position of the plane of eccentricity 53 is selected in which its angular distance a of the connection plane 44 in which the axis 56 of the fiiction roller 2 and the axis of rotation or bearing axis 17 of the eccentric shaft 8 are located should not be greater than 120°. It is also achieved at the assumed eccentricity e of about 1 mm to 2 mm, preferably 1.5 mm, that the adjustment angle β can be smaller than 90°. This also leads to the additional advantage that the radial movement component of the pivoting movement of the braking roller 3 related to the axis 56 of the friction roller 2 is smaller during the final phase of the adjustment angle/El than during its initial phase, so that a substantially more accurate setting of the desired width wl can be achieved. This radial movement component tends toward zero according to the sine function during the final phase of the adjustment angle. This gap width wl may be, e.g., 0.1 mm and correspond to a sheet width d of 0.1 mm, which in turn corresponds to a paper gauge of 80 g/m$^2$.

The mode of operation of the sluice, whose design was described above, will be described below in conjunction with the circuit diagram shown in FIG. 6. For simplicity's sake, this circuit diagram is provided with mechanical contact switches or with two switching relays R and R', with which the two electric motor drives 26 and 40 are controlled.

As can be seen, the two electric motors 26 and 40 are connected in parallel to the two switching relays R and R', wherein the switching relay R has contact switches r1, r2, and r3, while the switching relay R' has a total of four contact switches r'1, r'2, r'3, and r'4. The switching element 51, a pushbutton T1, which is to be actuated manually, and a switching contact r'4 of the switching relay R' are connected in series to one another in the circuit of the switching relay R, and the pushbutton T1, which is designed as a closing switch, can be bridged over by a locking contact r1 of the switching relay R.

The switching element 45, a pushbutton T2, which is to be operated manually, and a switching contact r3 of the switching relay R are connected in series to one another in the circuit of the switching relay R', and the pushbutton T2 can also be bridged over by a locking contact r'1 of the itching relay R'. The direction of rotation of the electric motor drive 40 and consequently also the direction of pivoting of the eccentric 7 or of the eccentric shaft 8 can be reversed by means of the switching contact r2 of the switching relay R, on the one hand, and of the switching contact r'2 of the other switching relay R', on the other hand.

The electric motor drive 26 is switched on and off by the contact switch r'3, which is located in the circuit of that drive.

To adjust the sluice or the passage gap 1 to another paper thickness or width w1, the relay R is energized by briefly actuating the pushbutton T1, and the said relay R closes the locking contact switch r1, opens the contact switch r3, and switches over the contact switch r2, so that the electric motor drive 40 brings about a pivoting movement of the eccentric in the opening direction, i.e., in the direction of arrow 42 (FIGS. 5*a* and 5*b*). This pivoting movement is terminated by the actuation of the switching element 51, whose switch is now opened. The relay R is thus again released. The starting state shown in FIG. 6 is again reached.

The passage gap 1 is now adjusted to a maximum width W of 1 mm.

A sheet of paper B, to the thickness d of which the passage gap 1 is to be adjusted, is pushed in this state through the said passage gap 1, and it is fixed either manually or by means of a special holding device. By actuating the pushbutton T2, the relay R' is energized, and this relay R' closes the switching contact r'1, switches over the switching contact r'2, doses the switching contact r'3, and thus switches on the motor drive 26 and opens the switching contact r'4 at the same time in order for an actuation of the pushbutton T1, which is not intended during this time, to remain ineffective.

The two electric motor drives 26 and 40 are thus switched on together by the short-term actuation of the pushbutton T2. The braking roller 3 now performs on the eccentric 8 a continuous rotary movement at an angular velocity that is about 30 to 40 times the angular velocity of the eccentric 7 rotating around the axis of rotation and bearing axis 17 in the closing direction indicated by arrow 43. The friction roller 2 is stopped during this time.

As soon as the braking roller 3, rotating in a direction of rotation opposite the pivoting movement of the eccentric 7, presses with its jacket surface the sheet of paper B inserted against the jacket surface of the stopped friction roller 2 so strongly that the braking roller 3 comes to a stop, the worm 15, which initially continues to rotate, is moved axially in the downward direction due to the worm engagement with the worm gear 14 with its worm shaft 16 and with the spur gear 23 (relative to FIGS. 1, 5*a*, 5*b*, and 5*c*), so that the worm shaft 16 opens the switching element 45 via the switch lever 47 of the microswitch 46 and opens the circuit of the switching relay R'. The contact switches r'1, r'2, r'3, and r'4 will then all instantaneously return into their starting position shown in FIG. 6, in which the two motor drives 26 and 40 are switched off. Thus, the two electric drives 26 and 40 stop instantaneously with the opening of the switching element 45. Due to the relatively great difference between the speed of rotation of the braking roller 3 and the velocity of pivoting of the eccentric 7, the slight delay in time that develops between the stopping of the braking roller 3 and the opening of the switching element 45 hardly noticeably affects the reduction in the passage gap 1 taking place during this time, especially if the radial movement of the eccentric related to the pivoting angle in relation to the axis 56 of the friction roller 2 is substantially smaller during the final phase of the adjustment angle β than during the initial phase of the adjustment angle β.

The passage gap 1 of the sluice can thus be adjusted to the thickness of the sheet of paper B, a film or the like just inserted very rapidly and accurately with the above-described device according to the present invention. The operator is not required to have any special skill, because this adjustment is performed automatically by means of two self-controlled electric drives.

Figure 6:
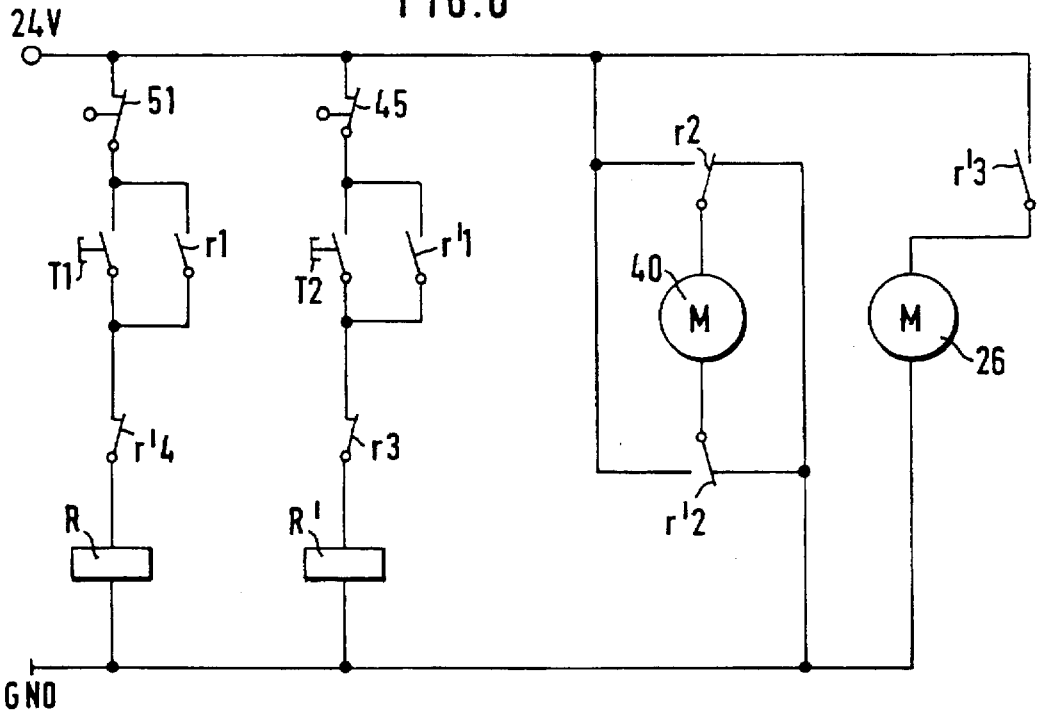
FIG. 6 is a schematic diagram of the control of the two electronic drives.

Instead of the circuit with mechanical switching elements shown in FIG. 6 or a similar circuit, it is also possible to provide an electronic control device controlled by a microprocessor or the like, which needs only one of the two pushbuttons T1 or T2 and performs an automatically alternating switchover between the opening process described and the likewise described dosing process of the passage gap. Only a single-time actuation of the same pushbutton T1 or T2 is required to open the passage gap 1 and to adjust it to a certain thickness d of an inserted sheet of paper or the like.

Using an electronic control circuit, it is also possible without difficulty to have the drive 40 of the eccentric shaft 8 perform—after completion of an adjusting movement in the closing direction of the passage gap 1, a minimum opposite opening movement, by which the passage gap is again widened by 0.01 to 0.04 mm, by briefly switching over its direction of rotation. The above-described time delay during the switching off of the electric motor drive can be compensated hereby.

The engagement between the worm gear 14 and the worm 14 [sic, 15 - Tr. Ed.], which is preferably designed as a self-locking engagement with a small face clearance, also offers the advantage that a further locking of the braking roller 3 during the normal working operation is not necessary.

Another advantage in terms of the handling of the above-described arrangement can be considered to be fact that the friction jacket 5, which wears off after the passage of a certain number of sheets in the area of the passage gap 1, adjusts itself with another circumferential section to the gap area after each readjustment of the passage gap 1. In addition, it is easy to bring about an adjustment, i.e., a slight rotation of the braking roller 3 on the stationary eccentric 7, which becomes necessary before the next adjustment of the passage gap 1, either by briefly switching on the electric motor 26, or by manually rotating the worm shaft 16.

While a specific embodiment of the invention has been shown and described in detail to illustrate the application of the principles of the invention, it will be understood that the invention may be embodied otherwise without departing from such principles.

What is claimed is:

1. A web and sheet sluice device, adjustable to different material thicknesses for sheets, webs, paper, paper webs, paper sheets and films which are fed to a processing or treating unit, the device comprising:

a friction roller which rotates continuously during a working operation;

a braking roller which is axially parallel to said friction roller;

an eccentric shaft;

a cylindrical eccentric connected to said eccentric shaft, said braking roller being rotatably mounted on said cylindrical eccentric;

a first motor drive connected to said eccentric shaft;

a second motor drive connected to said bragg roller for driving said braking roller;

driving gear means connected between said braking roller and said first motor drive for transmitting rotary motion of said second motor drive to said eccentric shaft and for moving out of a normal position when a gap width to be set has been reached;

switching element means for stopping said two motor drives upon said driving gear means being moved out of its normal position.

2. A sheet and web sluice according to claim 1, further comprising:

microprocessor means for controlling said two motor drives; and one of an electric. and electronic switch, which is to be actuated manually, associated with said microproeessor for opening and adjusting to said passage gap, and upon repeated actuation, said switch means alternatingly switching on said first drive to open said passage gap via said eccentric shaft and switching on both said first drive and said second drive to adjust said passage gap to said desired width.

3. A web and sheet sluice according to claim 2, wherein said microprocessor controls said first motor drive, upon completion of an adjusting movement in a closing direction of said passage gap, to perform a minimum opposite opening movement with a brief reversal of direction of rotation for widening said passage gap by from 0.01 mm to 0.04 mm.

4. A web and sheet sluice according to claim 1, wherein said driving gear means includes a movable gear shaft for actuating said switching element means, said movable gear shaft being connected to a gear worm and to a worm gear, said worm gear being mounted on said eccentric cylinder, said eccentric cylinder, said eccentric shaft and said braking roller being adopted to rotate in unison, said movable gear shaft being connected to said second motor drive via axially displaceable gear engagement means.

5. A web and sheet sluice according to claim 1, wherein said first motor drive and said second motor drive each include electric motors which can be controlled separately, said electric motor of said first motor drive being reversible to drive in each of two directions of rotation.

6. A web and sheet sluice according to claim 5, further comprising angular position electric switching element means for detecting an angular position of said eccentric shaft and switching said electric motor based on said angular position.

7. A web and sheet sluice according to claim 6, further comprising an actuating element arranged on said eccentric shaft and adjustable in a circumferential direction of said eccentric shaft for actuating said switching element means.

8. A web and sheet sluice according to claim 1, wherein said first motor drive and said second motor drive drive said eccentric shaft and said braking roller respectively, during an adjustment of said passage gap, wherein an angular velocity of said braking roller is at least 25 times greater than an angular velocity of said eccentric shaft.

9. A web and sheet sluice according to claim 1, wherein said jacket surface of said friction roller has a higher coefficient of friction than a jacket surface of said braking roller.

10. A web and sheet sluice according to claim 1, wherein said eccentric is disposed in a starting position providing a passage gap width which is at least 1/10 smaller than an eccentricity of said eccentric cylinder, said eccentricity defining a plane of eccentricity which forms an obtuse angle with a connection plane, between an axis of rotation of said eccentric shaft and an axis of rotation of said friction roller, which is smaller than 120°.

* * * * *